US006554681B1

(12) United States Patent
Tammera

(10) Patent No.: US 6,554,681 B1
(45) Date of Patent: Apr. 29, 2003

(54) TOY TRAIN BOX CAR

(76) Inventor: Robert F. Tammera, 7081 Auburn Mill Rd., Warrenton, VA (US) 20187

( * ) Notice: Subject to any disclaimer, the term of this patent is extended or adjusted under 35 U.S.C. 154(b) by 0 days.

(21) Appl. No.: 10/229,975

(22) Filed: Aug. 28, 2002

(51) Int. Cl.[7] ..... A63H 17/25
(52) U.S. Cl. ..... 446/288; 446/427; 446/467
(58) Field of Search ..... 446/288, 427, 446/428, 467

(56) References Cited

U.S. PATENT DOCUMENTS 2,260,460 A * 10/1941 Klingebiel
2,288,837 A * 7/1942 Pettit
2,302,142 A * 11/1942 Pettit
2,305,491 A * 12/1942 Pettit
2,444,961 A * 7/1948 Smith
2,450,867 A * 10/1948 Smith
2,585,731 A * 2/1952 Bonanno
2,634,551 A * 4/1953 Smith
2,658,307 A * 11/1953 Pettit
2,813,648 A * 11/1957 Pettit
3,214,864 A * 11/1965 Herman
6,280,278 B1 * 8/2001 Wells ..... 446/25
6,485,347 B1 * 11/2002 Grubba et al. ..... 446/25

* cited by examiner

*Primary Examiner*—Derris H. Banks
*Assistant Examiner*—Ali Abdelwahed
(74) *Attorney, Agent, or Firm*—Edward Goldberg

(57) ABSTRACT

A toy train box car includes an electrically operated miniature motor and gear drive which initially actuates a shuttle mechanism to open a sliding door and cause cargo items to be moved from a storage bin for loading onto a hand cart. As the door opens, a cold mist generator is energized to simulate cargo being unloaded from a refrigerated box car. The shuttle mechanism includes a rack and pinion which moves a figure pushing the hand cart out of the fully open door and an ejector arm offloads the cargo items onto an external loading ramp. The operating cycle then returns the hand cart into the car to receive another cargo item when the door is fully closed. The cycle is then completed and the motor inactivated until a new cycle is initiated.

15 Claims, 7 Drawing Sheets

FIG. 1
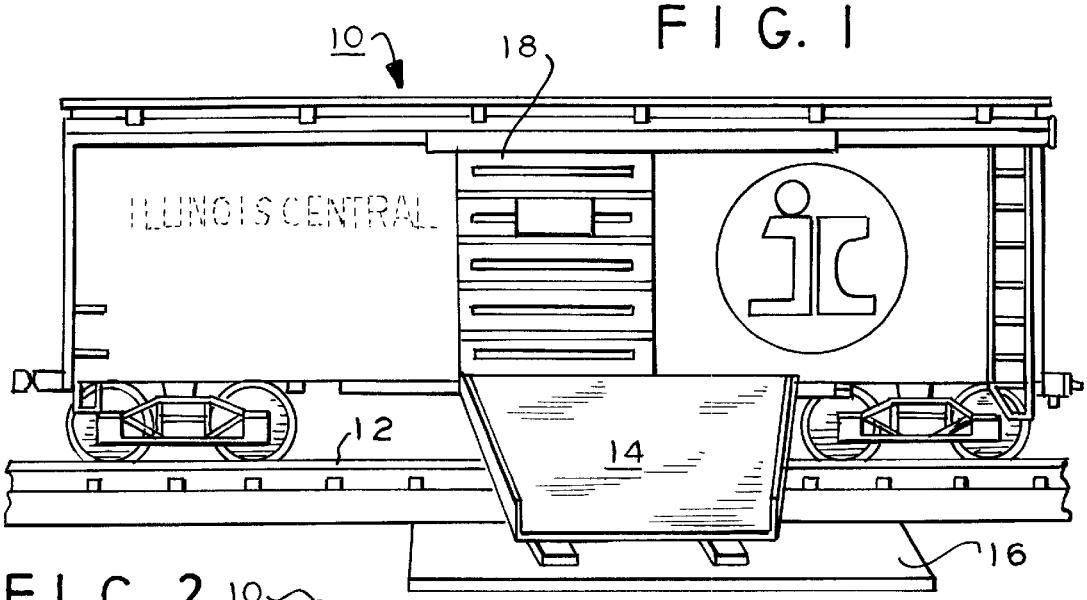
FIG. 2
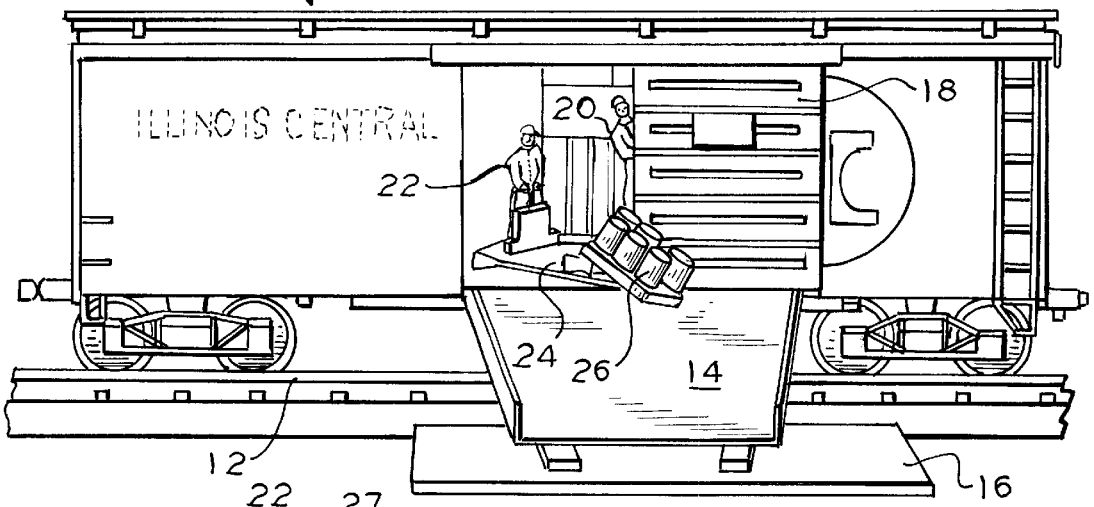
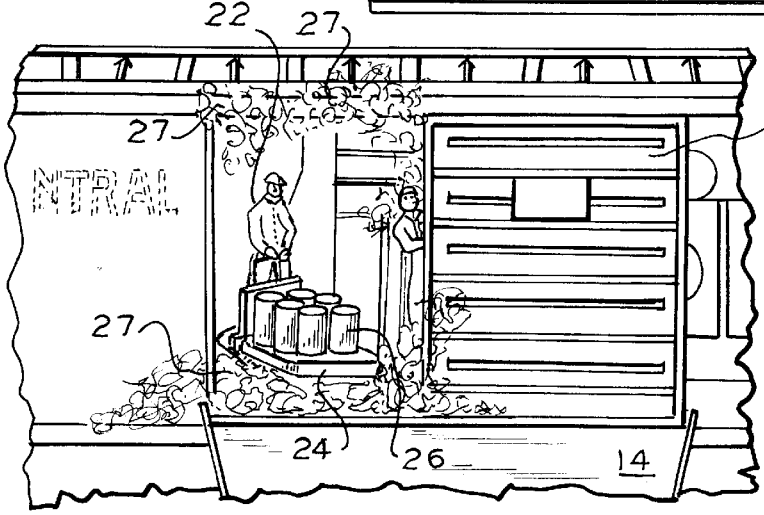
FIG. 2a

TOY TRAIN BOX CAR

BACKGROUND OF THE INVENTION

1. Field of the Invention

The present invention concerns a toy train box car having an operating mechanism for opening a door and unloading cargo. A sliding door is opened to permit discharge of items received from an internal cargo bin onto a handcart which is rotated out of the door and offloaded onto an external ramp. The handcart is returned and the door is closed to prepare for a repeat of the cycle to unload additional cargo items.

2. Description of the Prior Art

Previous devices for simulating a train car having the capability for opening a door and having a mechanism extending from the door to retrieve or deliver an item such as a mailbag include U.S. Pat. No. 2,260,460 to Klingebiel which utilizes springs and solenoids to control a bag catcher.

U.S. Pat. No. 2,634,551 to Smith relates to a toy train car storing round objects for delivery onto an unloading platform. An electromagnetic mechanism releases one article at a time onto a hand truck which shifts from the inside of the car to an edge. The hand truck has a moveable wall which is released when passing beyond the car edge so that the article rolls away from the car down the wall onto the unloading platform. Upon deenergization of the magnet, a spring returns the truck with the wall elevated into the car for release of the next item.

U.S. Pat. No. 2,813,648 to Pettit shows a toy train car which carries toy barrels to be discharged by a remote control device. A longitudinally sloping electromagnetically operated vibratory ramp shifts the barrels for ejection onto the ramp. A lockable cam controls the release of one barrel at a time.

U.S. Pat. No. 3,214,864 to Herman illustrates a toy figure on a train car simulating a baggage man moving a loaded hand truck out to a platform alongside the car. A ramp moves from an upright position when the figure is inside the car to a horizontal position when the figure and hand truck are outside the car. A solenoid, plunger and crank mechanism control movement of the figure and hand truck.

While these prior art devices show various mechanisms for simulating the unloading of cargo items from a toy train car onto an external ramp, none of these utilize a motor and gear drive to operate a sliding door of a toy box car or an internal cargo bin to discharge items onto a hand cart which is rotated out of the door with an ejector arm to off load the cargo onto the ramp. There also is no other device which returns the hand cart while closing the door to receive other items from the bin for another loading cycle.

SUMMARY OF THE INVENTION

It is therefore the primary object of the present invention to provide a novel mechanism for simulating the unloading of cargo items from a toy train box car.

It is another object of the invention to provide a unique mechanism for opening and closing a sliding door of a toy train box car.

It is a further object of the invention to provide an internal cargo bin which stores items to be loaded onto a hand cart.

It is an additional object of the invention to provide a mechanism for loading the cargo items onto the hand cart.

Yet another object is to provide a mechanism for moving the hand cart out onto the loading ramp.

It is also an object of the invention to provide a mechanism for ejecting a cargo item from the hand cart onto the loading ramp.

A still further object is to provide a return mechanism for the hand cart upon closing of the door to receive another cargo item for the next unloading cycle.

An additional object is to provide a device for generating a cold mist to simulate unloading of cargo from a refrigerated box car upon opening of the car door.

These objects are achieved with a unique system including a push button control activating a microswitch and motor gear drive mechanism which moves a shuttle structure to open a sliding door and initiate transfer of cargo items from a storage bin for loading onto a hand cart. The shuttle drives a rack and pinion to move the hand cart out of the door and an ejector arm off loads the cargo item onto the external loading ramp. The cold mist generator operates in synchronism with the door opening for simulating cargo unloading from a refrigerated box car. The hand cart is returned into the car for receipt of another cargo item when the door is closed until activation of another operating cycle. Other objects and advantages will become apparent from the following description in conjunction with the accompanying drawings.

BRIEF DESCRIPTION OF THE DRAWINGS

FIG. 1 is a front perspective view of the toy train box car with the sliding door closed and positioned on tracks alongside a ramp and platform for unloading cargo items.

FIG. 2 is a front perspective view of the box car with the door open, a figure of an attendant holding the door open, and a second figure pushing a loaded hand cart out of the door onto the ramp.

FIG. 2(*a*) is a partial view of the open door with a simulated cold mist drifting out to appear as a refrigerated box car.

DESCRIPTION OF THE PREFERRED EMBODIMENTS

Figure 11:
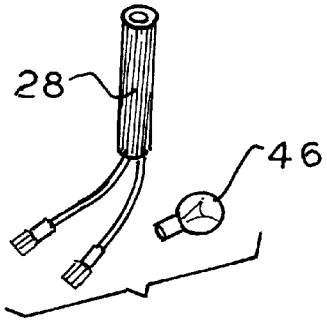
FIG. 11 illustrates a cylindrical cold mist generator and light bulb simulating and illuminating the unloading of cargo items from a refrigerated box car.

As shown in FIG. 1, a toy train box car 10 is positioned on track 12 alongside a loading ramp 14 and platform 16. A sliding door 18 along one side facing the ramp is in a closed position. FIG. 2 shows the box car with the door 18 open, an attendant 20 holding and riding on the door and a load handler FIG. 22 pushing a hand cart 24, with a load 26 delivered onto the ramp 14. FIG. 2(*a*) shows a simulated cold mist 27 which drifts out of the door when opened to give the appearance of a refrigerated box car. This is achieved with a few drops of smoke fluid inserted into a mist generator 28 shown in FIGS. 4 and 11.

Figure 3:
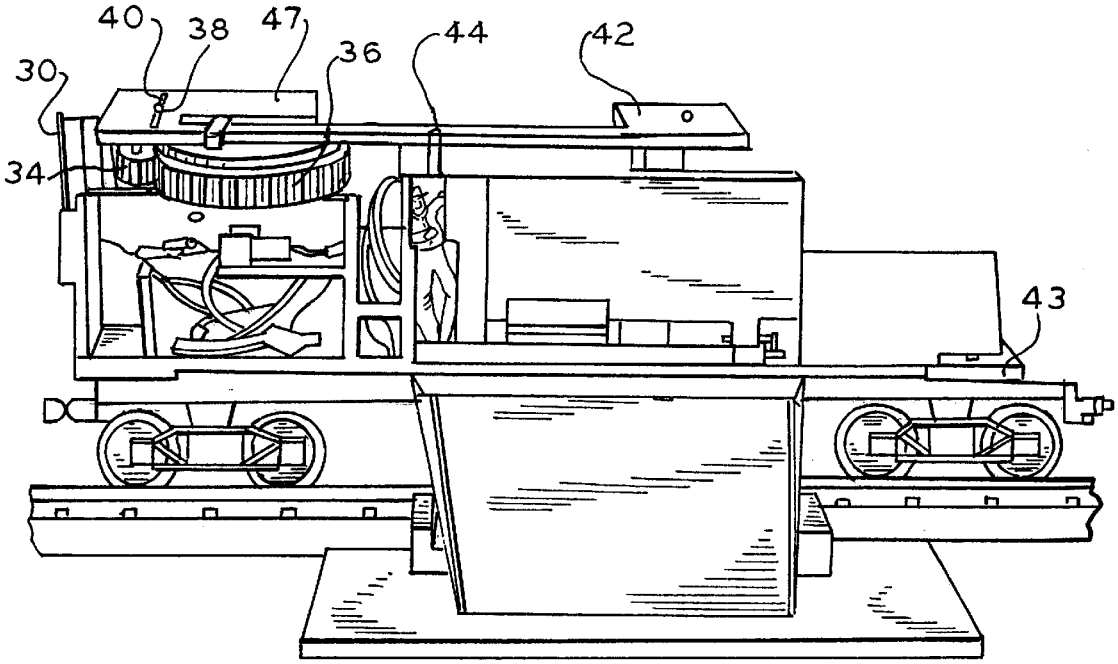
FIG. 3 is a front perspective view of the internal components of the box car with the outer shell and door removed and in an initial operating position before actuating the door opening mechanism.
Figure 4:
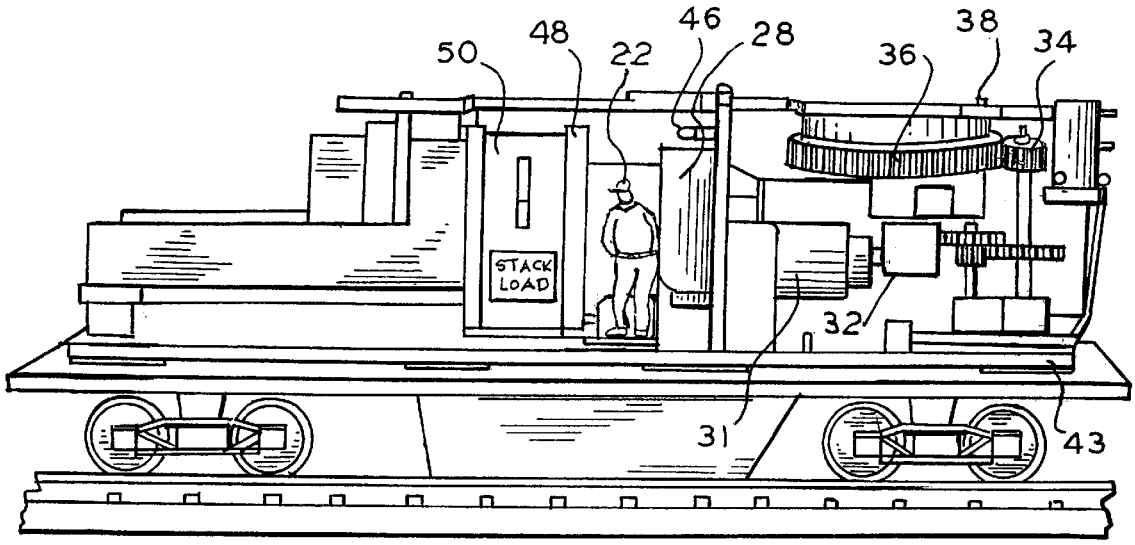
FIG. 4 is a rear perspective view of the internal components as shown in FIG. 3 in an initial position with the outer shell removed.
Figure 12:
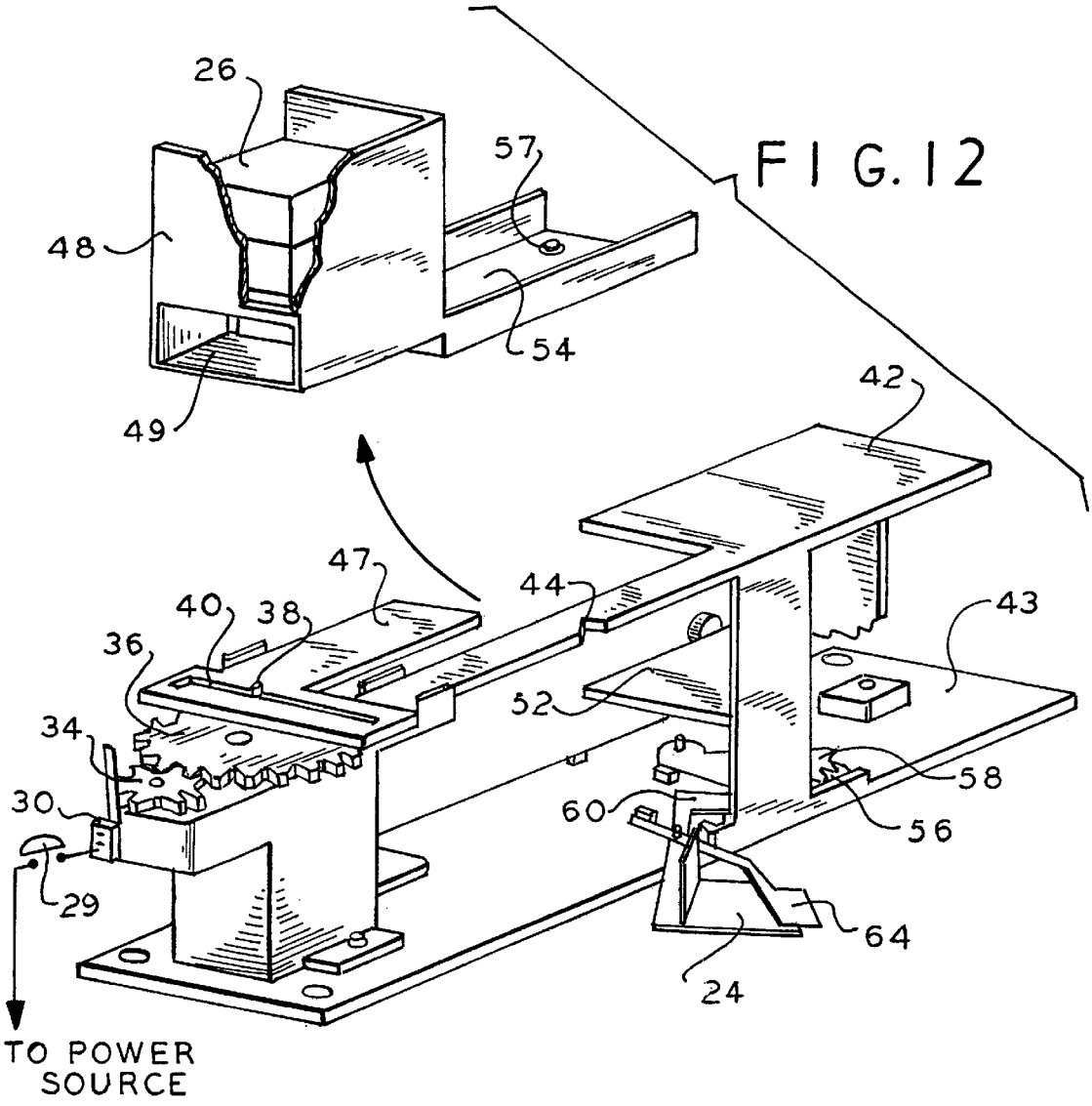
FIG. 12 illustrates exploded sectional views of the various internal mechanisms and assembled components of the cargo unloading system including the shuttle drive, cargo bin and hand cart in a position with the door fully open.

As shown in FIGS. 3 and 4 in front and rear views, the outer shell of the car 10 with door 18 lifted and removed to expose the internal components in an initial inactive position with the door closed as in FIG. 1 prior to actuating the door opening mechanism. As shown in FIG. 12, a push button control 29 connected to a power source, closes a microswitch and lever 30 to actuate a 3 volt, direct current motor 31 and gear reduction drive 32, shown in FIG. 4, which operate a pinion drive gear 34 and main drive gear 36. A vertical pin 38, shown more clearly in FIG. 12, projecting from gear 36, engages a lateral slot 40 in an upper section of a shuttle structure 42, shown further in FIGS. 7 and 12. Counterclockwise rotation the drive gear and pin moving down the slot from a starting central position drive the shuttle outwardly along a base plate 43 toward the other end. Door 18 includes an inner projection, not shown, which engages a notch 44 in an upper side edge of the shuttle causing the door to slide open with the movement of the shuttle.

FIG. 4 shows the rear view of the components before activating the motor with the load handler 22 ready to push the hand cart 24 out of the door. The mist generator 28 and a light bulb 46 are connected to the voltage source to be actuated by the microswitch 30 in synchronism with the opening of door 18. A horizontal portion 47 of the shuttle acts as a deflector to direct the mist downward and out of the door.

Figure 7:
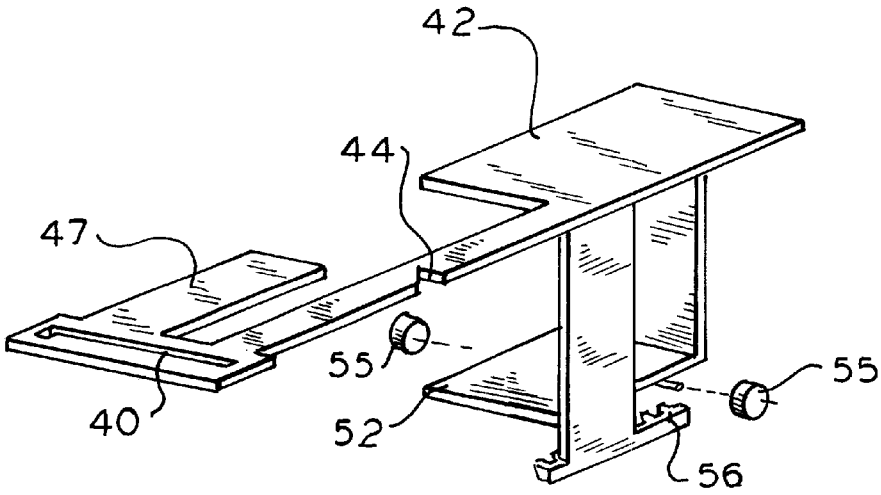
FIG. 7 is a front perspective view of the shuttle structure operated by the drive motor and gearing to move back and forth controlling the operation of the door and various cargo and hand cart movements.
Figure 8:
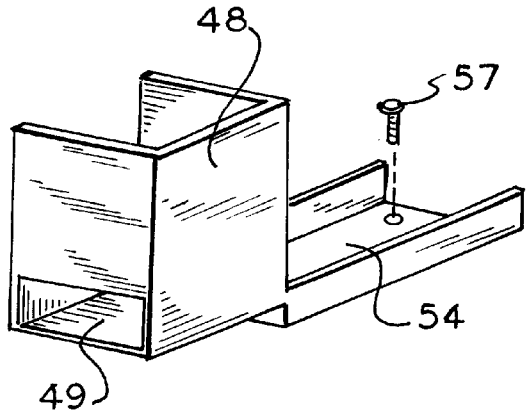
FIG. 8 is a front perspective view of the cargo bin which holds and releases cargo items onto the hand cart.

A cargo storage bin 48, shown in further detail in FIGS. 8 and 12, holds the load items 26 to be released through a lower bin opening 49 onto the hand cart 24 after completion of an operating cycle to be ready for unloading and delivery onto the loading ramp 14 upon the next door opening. A pivotable rear door 50 encloses a portion of the cargo bin. In order to place the load items into the rear of the storage bin, the operator lowers the rear door and the items are vertically stacked in the bin by hand. As shown in FIGS. 7 and 12, a shuttle index section 52 provides a base for the load items and moves along a trough 54 at the end of the bin. The closed rear door retains the cargo. Each time the front delivery door 18 is opened, one load item moved during the previous closing cycle onto the hand cart by the shuttle index is pushed out onto the ramp 14. As the index then moves away in the opening cycle another item drops into position for the next operation. The shuttle index 52 is guided on roller wheels 55 within trough 54. A fastener 57 in the trough secures the cargo bin structure to the base 43.

Figure 5:
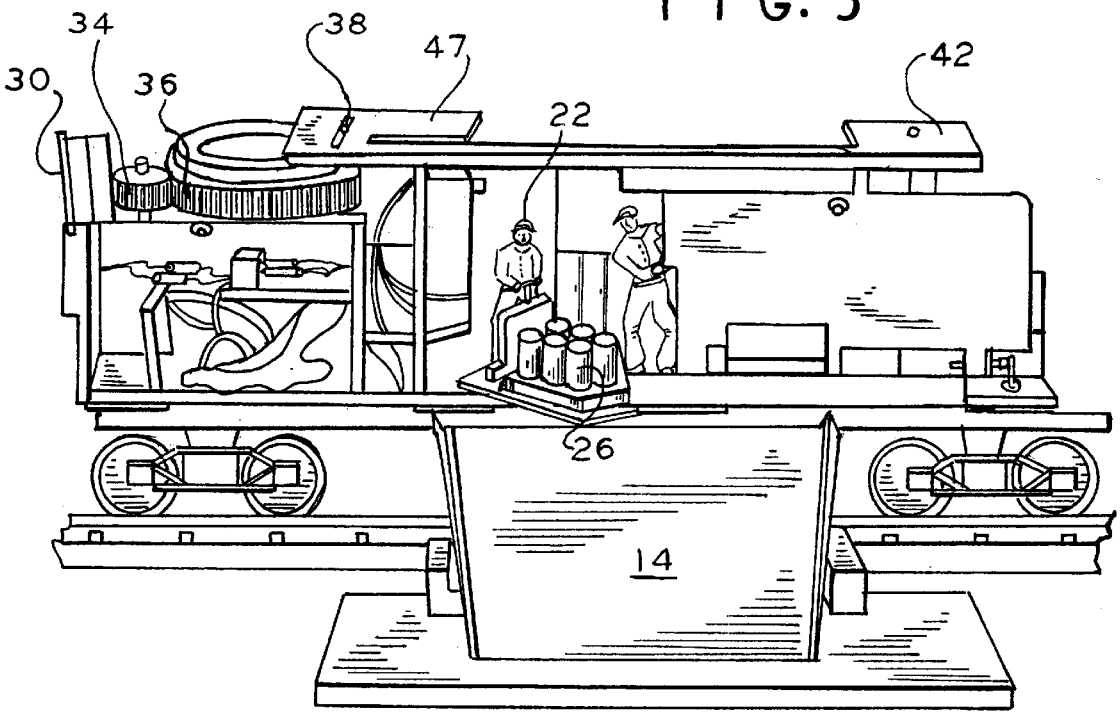
FIG. 5 is a front perspective view of the internal components in the operating position with the outer door fully open.
Figure 6:
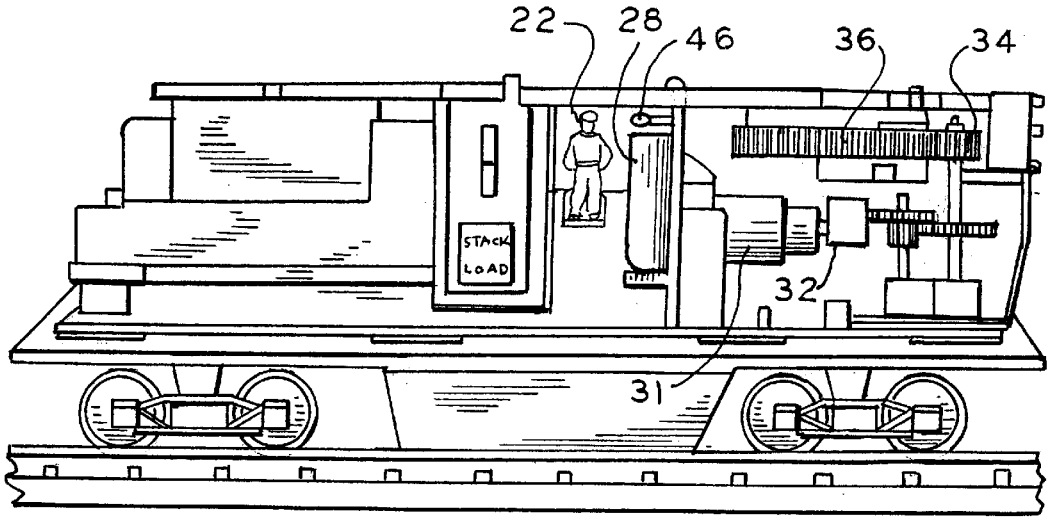
FIG. 6 is a rear perspective view of the internal components as shown in FIG. 5 with the door open.

FIG. 5 is a front view of the internal components with the door 18 in a fully open position. Drive gear 36 has moved halfway through a complete opening and closing cycle with pin 38 driving shuttle 42 to the far end. At this point load handler 22 has pushed the hand cart 24 with load 26 out of the open door 18, as shown in FIG. 2, ready to be unloaded onto ramp 14. FIG. 6 shows the rear view of these components and the load handler extending out of the opposite side opening.

Figure 10A:
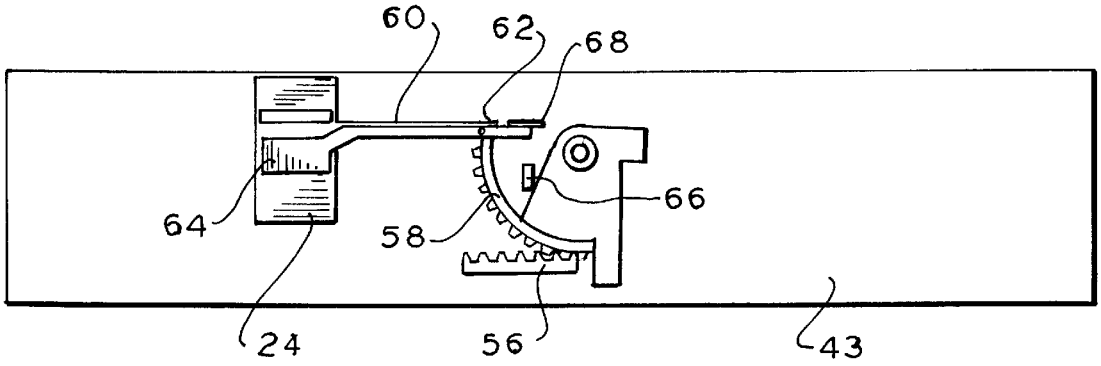
FIGS. 10*a, b*, and *c* schematically illustrate movement of the hand cart and ejector arm in offloading the cargo items under the control of a rack and pinion mechanism.
Figure 10B:
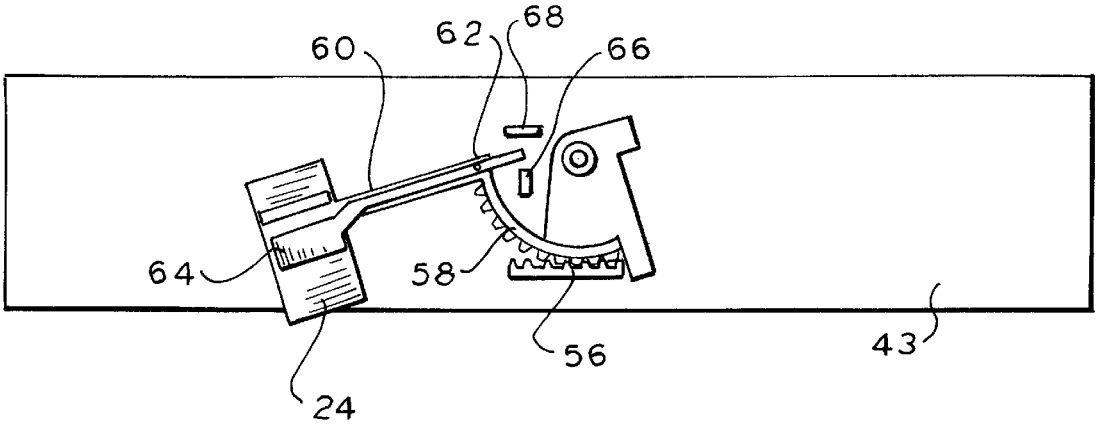
Figure 10C:
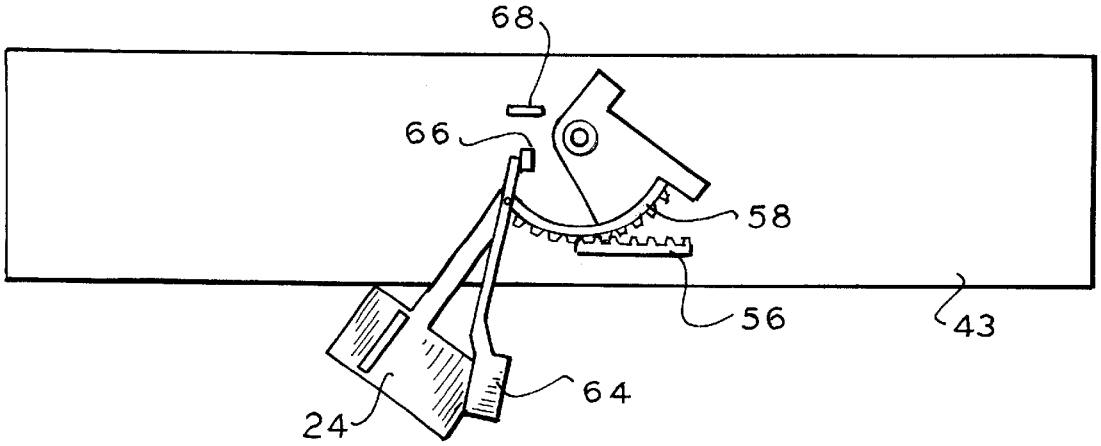

As shown in FIGS. 7, 10*a, b* and *c*, and FIG. 12, the movement of the hand cart 24 and load 26 are controlled by a rack 56 secured to an inner bottom wall section of shuttle 42. A pinion gear arc 58 is positioned on the base 43 and meshes with rack 56 to move in synchronism with the shuttle. The inner end of the hand cart is connected by a link 60 to an inner end 62 of the pinion gear and moves outward in an arc as the shuttle advances the rack 56 and turns pinion 58. An ejector arm 64 having a flat outer end positioned on the platform of the hand cart is pivotally linked at the other end to the inner end 62 of the pinion gear 58 and moves with the hand cart, as shown in FIG. 10(*b*). The final movement of the hand cart onto the loading ramp is limited by the position of the rack while the ejector arm continues to pivot beyond the end of the cart as in FIG. 10(*c*) to push the load off onto the ramp 14. A tab or stop 66 secured on base 43 limits outer movement of the ejector arm. In the return cycle when the shuttle moves back to close the car door 18, the rack 56 moves the pinion gear 58 in the opposite direction to return the ejector arm and hand cart to the original position as in FIG. 10(*a*). Another fixed tab or stop 68 locks the ejector arm in that position until the next cycle of operation.

Figure 9A:
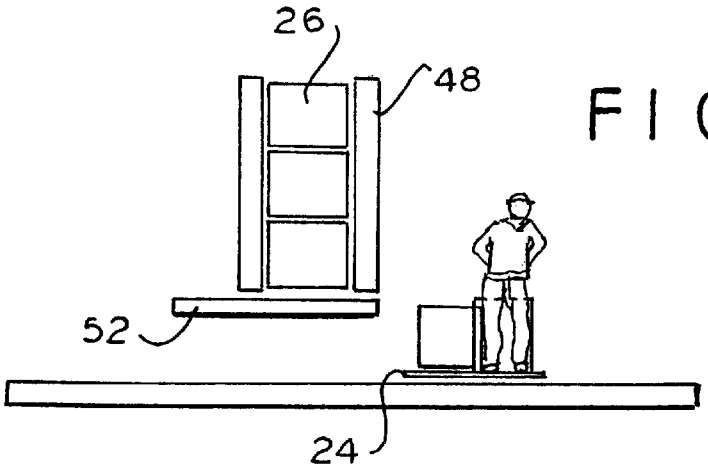
FIGS. 9*a, b*, and *c* schematically illustrate movement of cargo items from the cargo bin onto the hand cart as controlled by movements of the shuttle.
Figure 9B:
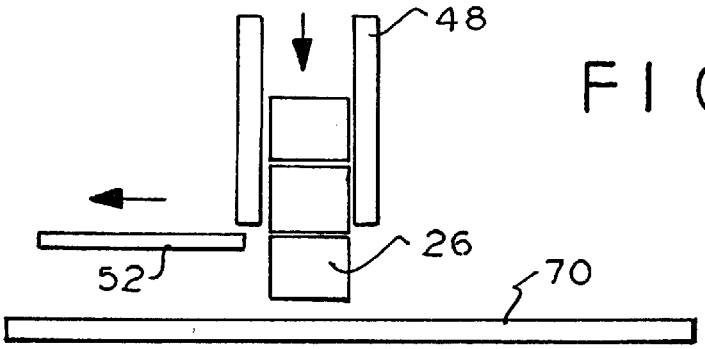
Figure 9C:
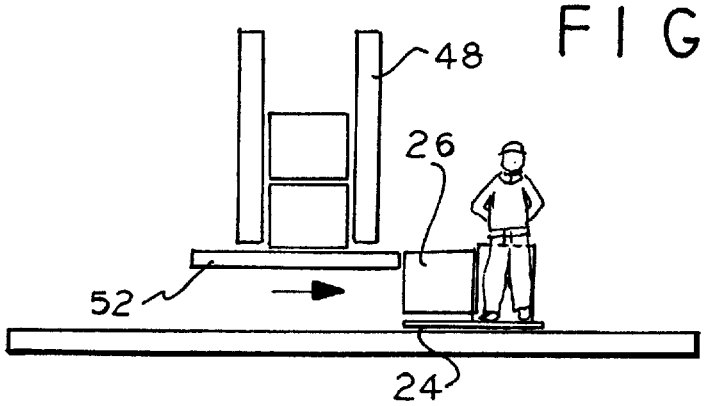

The complete sequence of loading the load items 26 from the storage bin 48 onto the hand cart 24 is illustrated in FIGS. 9*a, b* and *c*. In the initial inactive condition shown in 9(*a*) with the car door 18 in a closed position, the load items 26 are stacked vertically in the bin 48 supported by the shuttle index section 52. Hand cart 24 holds a previously released item. Upon actuation of the drive motor and gear to move the shuttle and open the door 18 as in 9(*b*), the index section 52 moves away to release the lower load item 26 onto a bottom support area 70 while the hand cart 24 has moved the previous item out of the door. When the shuttle index and hand cart return during the door closing operation as in 9(*c*), the index pushes the next load item onto the hand cart ready for the next cycle of operation.

The entire sequence of operation of the various mechanisms can be described in connection with the components shown in FIG. 12 in a mid cycle position with the door fully open. One complete cycle of operations is initiated by pressing push button 29 to close micro-switch and lever 30 which applies direct current to drive motor 31. The motor operates a pinion drive gear 34 and main drive gear 36. A vertical pin 38 projecting from gear 36 engages a lateral slot 40 in the closer end of the shuttle structure 42 which initially would be positioned over the pinion gear 34 prior to opening door 18. Counterclockwise rotation of the drive gear causes pin 38 to move downward from a center position in slot 40 which drives shuttle 42 in a linear direction outwardly toward the other end. This movement initiates the opening of door 18 and the operation of the cold mist generator 28 and bulb 46. Shuttle index 52 moves away to drop a load item 26 onto the bottom of cargo bin 48, the hand cart 24 moves out of the open door with a previously loaded item as rack 56 drives pinion gear 58. After one half cycle of a complete revolution of drive gear 36, pin 38 will have traveled down to the end of slot 40 and then back up to the midpoint of the slot as shown in FIG. 12. Door 18 is now in a fully open position as in FIGS. 2 and 5 with the shuttle having reached its limit of movement. At this point the ejector arm 64 will have pivoted outwardly to push the load off hand cart 24 onto loading ramp 14.

On the return half cycle of the complete counterclockwise revolution of drive gear 36, pin 38 continues to travel up to the other end of slot 40 and then back down to the mid starting point. During this portion, the door 18 is closed, the hand cart 24 and ejector arm 64 are returned to their original starting positions, shuttle 42 moves back to its original position and shuttle index 52 pushes the next load item onto the hand cart for the next cycle of operation. Finally the shuttle engages the microswitch and lever arm 30 to open the circuit to the power source and stop drive motor 31. The mechanism thus operates unattended for one complete cycle of a 360 degree rotation of the drive gear with the system automatically shut down until another cycle is initiated by again pressing the push button control.

As shown in various figures, the major component parts such as the outer car shell, the shuttle, the cargo bin and hand cart are readily removable manually and easily reassembled, with only one screw securing the cargo bin to the base plate. The drive motor and gearing are more permanently secured.

While only a single embodiment has been illustrated and described, variations may be made in the particular components and mechanisms without departing from the scope of the invention as set forth in the appended claims.

What is claimed is:

1. A toy train box car comprising:

a base, an outer shell having side and end walls and a roof mounted on said base, a front side wall of said shell including a front side door slidable between closed and open positions, electrically operated drive means mounted on said base within said shell, control means connecting said drive means to an electrical power source to activate said drive means, a shuttle mechanism within said shell driven by said drive means to initially open said side door and then return said door to said closed position, a cargo bin mounted on said base within said shell, said cargo bin including a storage enclosure and cargo items held within said enclosure, a movable cart receiving cargo items from said enclosure in an inner position when said door is closed and moving said items out of said door in an outer position when said door is open, said shuttle mechanism including means to move said cart between said positions and means for loading said cargo items onto said cart when said door is closed, and means coupled to said shuttle mechanism for offloading said cargo items from said cart when said front side door is open, said drive means causing said shuttle mechanism to return said cart to said inner position when closing said door and to deactivate said control means.

2. The toy train box car of claim 1 wherein said drive means includes an electrical motor, a drive gear assembly and a main drive gear having a pin extending from an upper surface area, said shuttle mechanism extending along and slidable on said base and having a lateral slot in an upper section engaging said pin, rotation of said main gear moving said pin back and forth within said slot causing longitudinal movement of said shuttle mechanism outwardly from and returning inwardly toward said drive means, said shuttle mechanism having a notch in an upper side edge engageable with said side door for opening and closing said door.

3. The toy train box car of claim 2 wherein said control means includes a switch activating said motor and rotation of said main gear for one cycle of operation causing movement of said pin and shuttle mechanism, return movement of said shuttle mechanism deactivating said switch and motor.

4. The toy train box car of claim 3 wherein said shuttle mechanism includes a rack positioned on said base and moveable longitudinally with said shuttle mechanism, and a pinion gear coupled to said rack and rotatable in an arc, said cart having a link connected to said pinion gear and being movable therewith in an arc between said inner and outer positions, and an ejector arm having one end pivotally connected to said pinion gear and the other end overlying a surface of said cart and holding said cargo items, said ejector arm being movable with said cart and pivoting to offload said cargo items when said door is open and returning with said cart when said door is closed.

5. The toy train box car of claim 4 wherein said shuttle mechanism includes a shuttle index providing an inner lower platform supporting said cargo items within said storage enclosure, movement of said shuttle index away from said storage enclosure during the opening of said side door causing one cargo item to drop downward onto a lower surface of said storage enclosure, return movement of said shuttle index, when said door is closed causing said cart to return to said inner position to receive said one cargo item from said enclosure, and return movement of said shuttle index into said enclosure pushing said one cargo item onto said cart and providing support for remaining cargo items in said enclosure.

6. The toy train box car of claim 5 wherein said cart inner position is along a side of said enclosure, said enclosure having a lower side opening adjacent said cart, said cargo bin including a trough along an opposing side of said enclosure, said shuttle index being mounted on wheels and slidable along said trough for movement into and out of said enclosure for loading said cargo items onto said cart.

7. The toy train box car of claim 6 wherein said storage enclosure includes a rear pivotable door operable manually, said pivotable door having an open position for manually inserting cargo items into said enclosure, said items being vertically stacked and supported on said shuttle index lower platform for loading onto said cart, said pivotable door having a closed position for retaining said items in said enclosure.

8. The toy train box car of claim 7 wherein said cart includes a figure of a load handler standing on a rear of said cart with arms outstretched to appear to be pushing said cart.

9. The toy train box car of claim 8 wherein a second standing figure is secured inside an opening edge of said front side door to appear to be pushing said front side door.

10. The toy train box car of claim 9 wherein an outer shell rear side wall includes a rear side door manually slidable between closed and open positions, said rear door providing access to said storage enclosure pivotable door for inserting said cargo items therein.

11. The toy train box car of claim 10 including a cold mist generator positioned within said shell adjacent said rear side door, said mist generator being connected to said electrical power source for actuation by said control means switch, said mist generator containing a manually inserted smoke fluid generating mist upon actuation, an upper section of said shuttle mechanism positioned above said mist generator deflecting said mist out of said front side door upon opening thereof simulating an appearance of a refrigerated box car, and including a miniature light bulb activated by said switch for illuminating said mist.

12. The toy train box car of claim 1 wherein said shell and base are mounted on wheels, and toy train tracks engaging said wheels.

13. The toy train box car of claim 12 including a ramp positioned alongside said tracks for receiving said cargo items offloaded from said cart when said front side door is open.

14. The toy train box car of claim 1 wherein said outer shell, shuttle mechanism, cargo bin and cart are manually removable from said base and manually reassembleable.

15. The toy train box car of claim 14 wherein said cargo bin includes a screw securing said cargo bin to said base.

* * * * *